US007913982B2

(12) United States Patent
Svedberg

(10) Patent No.: US 7,913,982 B2
(45) Date of Patent: Mar. 29, 2011

(54) TEMPORARY SAFETY BARRIER SYSTEM

(75) Inventor: Joakim Svedberg, Froesoen (SE)

(73) Assignee: Combisafe International AB, Ostersund (SE)

( * ) Notice: Subject to any disclaimer, the term of this patent is extended or adjusted under 35 U.S.C. 154(b) by 0 days.

(21) Appl. No.: 11/919,549

(22) PCT Filed: May 17, 2006

(86) PCT No.: PCT/EP2006/004637

§ 371 (c)(1),
(2), (4) Date: Jan. 10, 2008

(87) PCT Pub. No.: WO2006/122763

PCT Pub. Date: Nov. 23, 2006

(65) Prior Publication Data

US 2008/0135821 A1 Jun. 12, 2008

(30) Foreign Application Priority Data

May 18, 2005 (EP) ..... 05104173

(51) Int. Cl.
*B21F 27/00* (2006.01)

(52) U.S. Cl. ..... 256/32; 256/65.01; 256/67; 256/73; 256/DIG. 2

(58) Field of Classification Search ..... 256/1, 32, 256/59, 65.01–65.03, 67–69, 73.24, DIG. 2, 256/DIG. 6, 24, 31, 73; 29/525.11–525.13, 29/897

See application file for complete search history.

(56) References Cited

U.S. PATENT DOCUMENTS

| | | | | |
|---|---|---|---|---|
| 2,329,260 | A * | 9/1943 | Freeman | 256/24 |
| 4,356,999 | A * | 11/1982 | McShane | 256/26 |
| 4,365,453 | A * | 12/1982 | Lowe | 52/478 |
| 5,299,781 | A * | 4/1994 | Barrett et al. | 256/12.5 |
| 5,542,649 | A * | 8/1996 | Allegaert et al. | 256/54 |
| 5,813,662 | A * | 9/1998 | Langkruis | 256/25 |
| 6,257,556 | B1 | 7/2001 | Park | |
| 6,336,623 | B1 | 1/2002 | McCarthy | |
| 6,637,171 | B1 * | 10/2003 | Toone | 52/677 |
| 6,807,710 | B2 * | 10/2004 | Abbott et al. | 16/221 |
| 7,086,641 | B2 * | 8/2006 | Petrozziello | 256/1 |
| RE39,842 | E * | 9/2007 | Purvis et al. | 256/67 |

FOREIGN PATENT DOCUMENTS

AU 573 869 6/1988

(Continued)

*Primary Examiner* — Michael P Ferguson
*Assistant Examiner* — Nahid Amiri
(74) *Attorney, Agent, or Firm* — Birch, Stewart, Kolasch & Birch, LLP

(57) ABSTRACT

The present invention relates to a temporary safety barrier system, which comprises a plurality of posts, a plurality of mesh panels, and a plurality of mesh panel holders. Each mesh panel holder is mountable on a respective post of said plurality of posts, and comprises a post coupler and first and second mesh panel supports, which are attached in common to the post coupler. The post coupler is movable along the post when mounted thereon, and has a locking member for releasably locking the post coupler in a holding position at the post. The second mesh panel support encircles the post in the mounted state. Each mesh panel support has a support hook for receiving a mesh wire of one or more mesh panels. The temporary safety system is arranged to enable inclination of a mesh panel during said height adjustment, thereby facilitating the height adjustment while the mesh panels remain mounted.

19 Claims, 5 Drawing Sheets

FOREIGN PATENT DOCUMENTS

| | | | |
|---|---|---|---|
| DE | 44 15 827 | A1 | 11/1995 |
| DE | 20 2004 006103 | U1 | 7/2003 |
| EP | 1 467 045 | A2 | 10/2004 |
| EP | 1621700 | A2 * | 2/2006 |
| FR | 2 347 508 | | 11/1977 |
| GB | 1 572 918 | | 8/1980 |

* cited by examiner

TEMPORARY SAFETY BARRIER SYSTEM

FIELD OF THE INVENTION

The present invention relates to temporary safety barrier system comprising a plurality of posts, a plurality of mesh panels, and a plurality of mesh panel holders.

BACKGROUND OF THE INVENTION

In construction and renovation safety barrier systems are used primarily above ground level in order to prevent workers, tools and material from falling down towards the ground. Safety barriers are also used in many other applications, such as a barricade preventing people from accessing an area.

A known safety barrier system of the type referred to in the introduction above, is disclosed in EP 1467045. This known system works well. However, in particular during construction work, there is often a need for adjusting the height of the barrier. For example, when a concrete platform has been cast, the new floor level for the workers is the upper surface of the platform, which can be several decimeters above the level that was present when the barrier was mounted. Consequently, when the workers begin to use the new platform the upper edge of the mesh panels of the barrier becomes too low to guarantee their safety. There is no possibility to adjust the height of the prior art safety barrier. Rather, it will have to be completely demounted and then mounted again on top of the concrete platform. In other situations there will be a need for lowering the mesh panels from a high position.

In for example AU 573 869 a bracket, which is useful for supporting a mesh panel, is disclosed. It is mountable in an optional position along a scaffolding frame tube, but the position is not adjustable when the mesh panel is mounted. In DE 20 2004 006103 a holder for holding rails is shown. The holder is mountable along a scaffolding frame tube, but it is not height adjustable after the rails have been mounted.

SUMMARY OF THE INVENTION

The object of the present invention is to provide a solution wherein the height of the mesh panels of a temporary safety barrier system is adjustable in a mounted state.

The object is achieved with a temporary safety barrier system according to claim 1 as well as with a temporary safety barrier post according to claim 11.

Thus, in accordance with an aspect of the present invention there is provided a temporary safety barrier system comprising a plurality of posts, a plurality of mesh panels, and a plurality of mesh panel holders. Each mesh panel holder is mountable on a respective post, and comprises a post coupler a first mesh panel support, and a second mesh panel support. The second mesh panel support is distanced from the first mesh panel support in a longitudinal direction of said post in a mounted state. Further, the mesh panel supports are attached in common to the post coupler. The post coupler is movable along the post for enabling height adjustment of the mesh panels in a mounted state, and comprises a locking member for releasably locking the post coupler in a holding position at the post. The second mesh panel support encircles the post. Each mesh panel support has a support hook for receiving a mesh wire of one or more mesh panels, and the temporary safety system is arranged to enable inclination of a mesh panel during the height adjustment.

Since the panel holder is movable along the post, and supports the mesh panel it is possible to adjust the height of the mesh panel by simply moving the panel holder. The panel support, being connected with the post coupler, provides a stable support for the mesh panel and is movable along the post for a simple height adjustment. The movement is guided by the encircling second mesh panel support and the movable post coupler. The support hooks support the mesh panels by the mesh wires. Thus, the mesh wires are movable on the hooks, which facilitates the inclination of the mesh panels during height adjustment. Since the system enables the mesh panels to incline, their weight remains being shared by two mesh panel holders throughout the height adjustment. Thereby it is made possible, or at least facilitated, to perform the adjustment while the mesh panels are mounted.

Further, each mesh panel support has a support hook for receiving a mesh wire of one or more mesh panels. The support hook provides for an easy mounting/demounting of the mesh panel and is large enough to support more than one mesh panel. It is natural to overlap the mesh panels slightly when mounting them, and the total number of posts required is reduced in comparison to a system where each post can only support one mesh panel.

According to an embodiment of the safety barrier system, the post coupler, or post connection member, comprises a ring shaped portion, which is arranged to encircle the post in a mounted state. That is, when the post coupler is mounted on the post, the ring shaped portion, which has a shape, such as rectangular, circular, etc., that depends on the shape of the post, encircles the post. Thereby the post coupler provides a good stability to the panel holder and enhances the movement thereof along the post.

According to an embodiment of the safety barrier system, at least one of said mesh panel holders comprise an aid connector, which is arranged to be connected with a height adjustment aid. The possibility of connecting to such an aid is advantageous for facilitating the height adjustment.

According to an embodiment of the safety barrier system, it comprises a height adjustment aid for aiding height adjustment of the mesh panels in the mounted state. The height adjustment aid comprises a lever, a support member, which is connectible with a post for supporting the aid, and a mesh panel holder connector. The lever is pivotably connected with the support member at a first connection portion, pivotably connected with the lever at a second connection portion, and connectible with said aid connector. The first and second connection portions are spaced along the lever. Some people may regard the weight of the mesh panel(s) annoyingly heavy when they are height adjusting the panel holder. The height adjustment aid enables a single person to easily height adjust the panel holder on his/her own.

According to an embodiment of the safety barrier system, the aid connector is comprised in the mesh panel support of each mesh panel holder. This embodiment provides a simple connection of the aid to the mesh panel holder, since, typically, the mesh panel support is positioned at the inside of the barrier, i.e. directed towards the workers.

The object of the present invention is also achieved with a method of adjusting the height of a mesh panel in a mounted state, wherein said mesh panel is comprised in a temporary safety barrier system, which further comprises a plurality of posts each having a mesh panel holder which is movably arranged on the post and comprises a mesh panel support supporting the mesh panel. The method comprises:

arranging a support member of a height adjustment aid, including a lever and a mesh holder connector, at the top of a post, said support member being pivotably connected to the lever at a first connection portion;

connecting said mesh holder connector, which is pivotably connected to the lever at a second connection portion longitudinally spaced from said first connection portion, to said mesh holder;

releasing said mesh holder from said post;

moving the mesh holder along the post into a new position by changing the vertical position of a proximal end of said lever; and locking said mesh panel holder at said post in said new position.

These and other aspects and advantages of the invention will be apparent from and elucidated with reference to the embodiments described hereinafter.

BRIEF DESCRIPTION OF THE DRAWINGS

The invention will now be described in more detail and with reference to the appended drawings in which.

DESCRIPTION OF EMBODIMENTS

Figure 1:
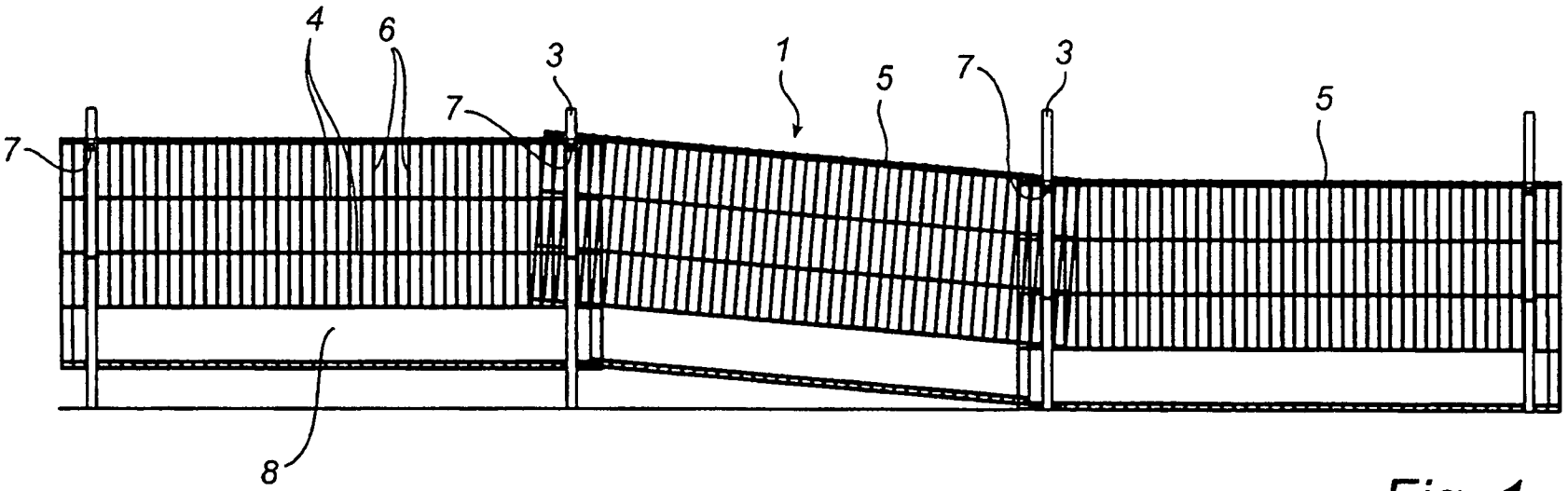
FIG. 1 in a front view shows a safety barrier system according to an embodiment of the present invention.
Figure 2A:
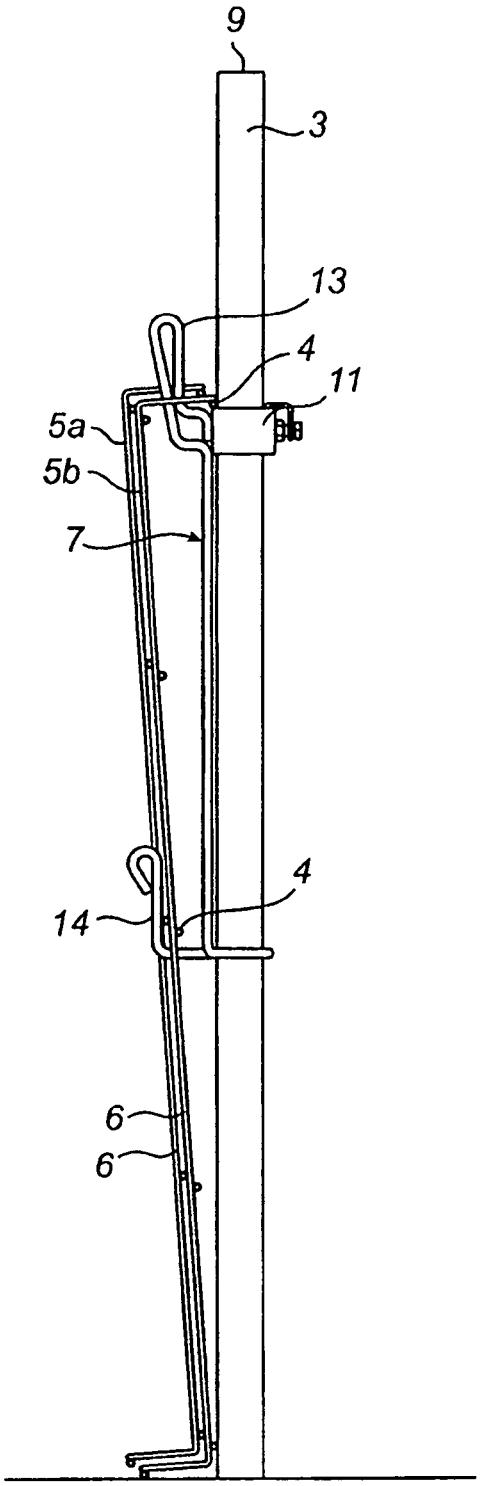
FIGS. 2*a* and 2*b* show parts of the system of FIG. 1 in side views.
Figure 2B:
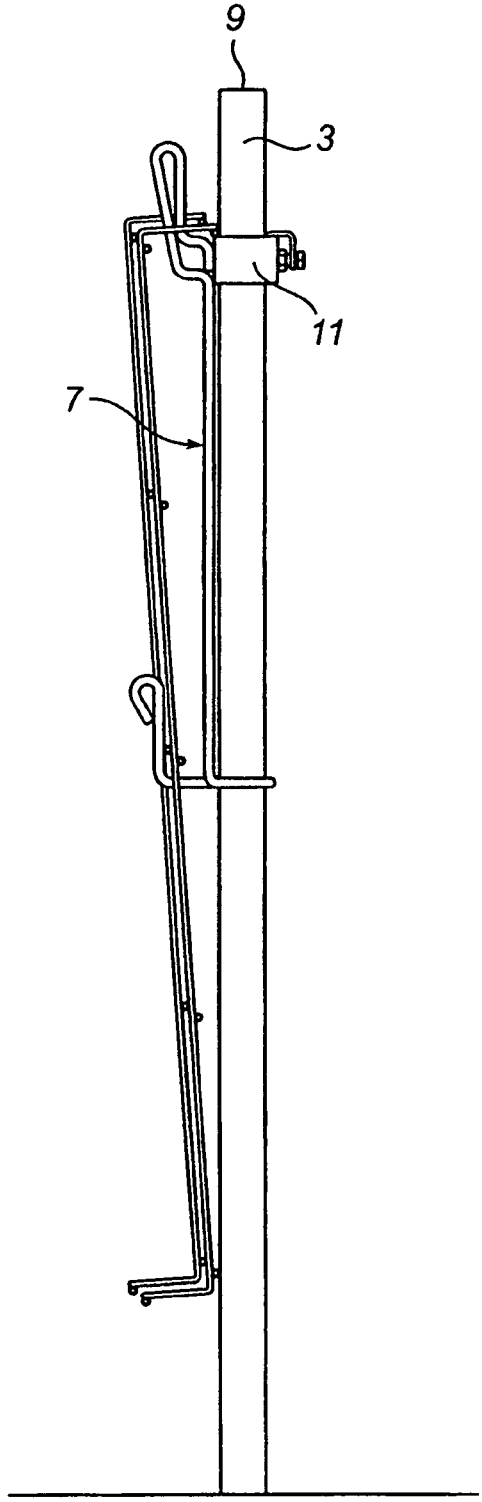
Figure 3:
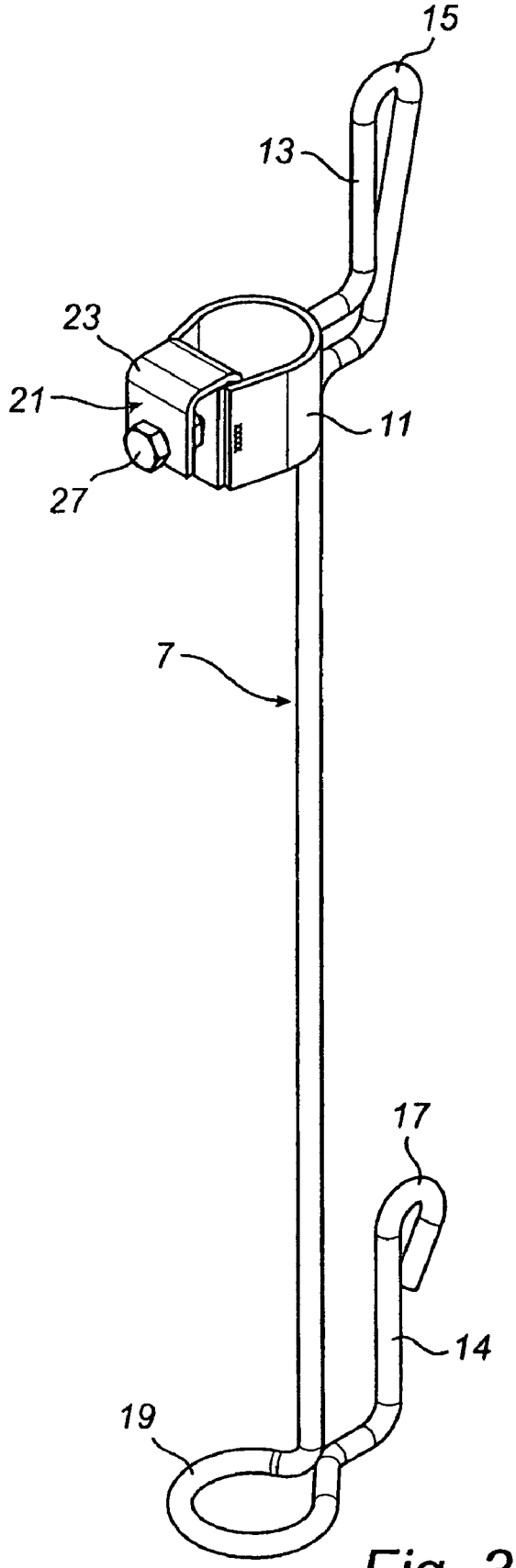
FIG. 3 in a perspective view shows a mesh panel holder used in the embodiment of FIG. 1.

An embodiment of the safety barrier system 1 is shown in a mounted state in FIG. 1. The system comprises a plurality of posts 3, a plurality of mesh panels 5, and a plurality of mesh panel holders 7. Each mesh panel comprises horizontal wires 4, vertical wires 6, and a foot plate 8, which is arranged at a bottom portion of the mesh panel 5. FIGS. 2*a* and 2*b* each shows a post 3 provided with a holder 7, which is arranged at different heights in FIGS. 2*a* and 2*b*, respectively. Two mesh panels 5*a*, 5*b*, which slightly overlap at respective ends thereof, are held by the holder 7. The holder 7 has been slipped on to the post 3 from a top end 9 thereof. The holder 7 comprises a post coupler 11, which is ring shaped in this embodiment, and which encircles, i.e. extends around, the post 3. The holder 7 further comprises upper and lower mesh panel supports 13, 14, attached in common to the post coupler 11. The supports 13, 14 are vertically distanced from each other, i.e. distanced in a longitudinal direction of the post 3. The distance is fixed and adapted to the distance between the horizontal wires 4 of the mesh panel 5. In this embodiment the distance equals to the height of two meshes of the mesh panel 5. Thus, a horizontal wire 4 rests against each support 13, 14 at a short portion of the wire 4.

In this embodiment a round bar that has been bent into an upper hooked portion constituting the upper support 13, and a lower hooked portion constituting the lower support 14. The hooked portions protrude upwards such that the mesh panels 5 can easily be hung thereon. The round bar is also formed into upper and lower loops 15, 17 being adjacent to the upper and lower hooked portions 13, 14 respectively. The lower loop 17 constitutes an end portion of the bar. The loops 15, 17 constitute aid connectors as will be further described below. The bar extends straight between the supports 13, 14, and is formed into a ring 19 at the lower support 14. The ring 19 encircles the post 3. The post coupler 11 has a locking member 21, which consists of a screw locking means comprising a screw 27 and a clamp 23. The clamp 23 is forceable against the post 3 by means of the screw 27, which is adjustable radially of the post 3. Thus, for locking the post coupler 11, and thus the holder 7, in a position simply the screw 27 is tightened, and for releasing the holder 7 the screw 27 is loosened.

The hooks of the hooked portions and the loops are all formed in a plane approximately perpendicular to the plane in which the mesh panels 5 extend between the posts 3. Thereby the laterally free space of each mesh that a support extends through is maximised, which in turn enhances height adjustment. When adjusting the height of the mesh panels 5, no demounting of the system is necessary, as shown in FIG. 1. In other words, the temporary safety barrier system 1 is arranged to enable height adjustment of the mesh panels 5 in the mounted state. A single person can change the height by simply changing the height of one mesh panel holder 7 at a time. In FIG. 1 the right most mesh panel is in a lower position; a middle mesh panel is in the lower position at a right end thereof and in a higher position in a left end thereof; and the left most mesh panel is in the higher position. Due to the lateral space within the meshes, it is possible to substantially incline a mesh panel during the height adjustment thereof, thereby allowing relatively high height adjustments at one mesh panel support at a time.

Figure 5:
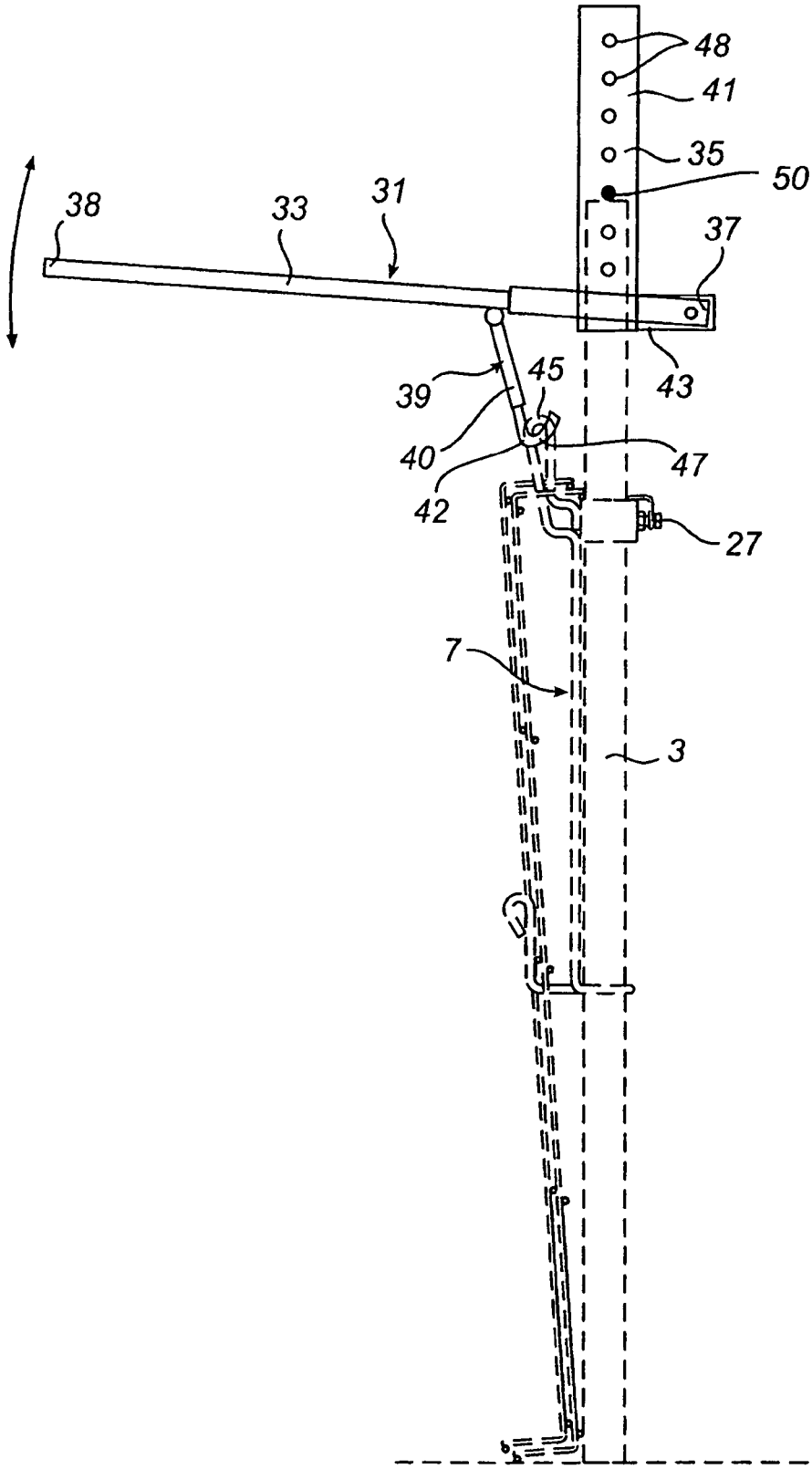
FIG. 5 in a side view shows a height adjustment aid according to an embodiment of the present invention.

In order to facilitate the adjustment of the height of the mesh panels 5, by adjusting the mesh panel holders 7, the safety barrier system comprises a height adjustment aid 31, as shown in FIG. 5. In FIG. 5 the rest of the safety barrier system, i.e. post, mesh panel, and mesh panel holder, is illustrated by broken lines. The aid 31 is advantageously used for raising as well as lowering the mesh panels 5. The aid 31 includes a lever 33, a support member 35, which is pivotably connected with the lever 33 at a distal end 37 thereof, and a mesh panel holder connector 39, which is pivotably connected with the lever 33 at a distance from, but relatively close to, the connection between the support member 35 and the lever 33.

The support member 35 consists of a tube 41, which is arrangeable over the top of the post 3, and a bracket 43 protruding from the bottom of the tube 41, perpendicularly to a longitudinal centre axis thereof, and being pivotably connected with the lever 33 at a distal end thereof. The tube 41 is provided with a series of means for positioning the aid 31 at different heights relative to the post 3. These positioning means constitutes of consecutive pairs of holes 48 along the length of the tube 41. A pin 50, which extends through the opposite holes of a pair, is movable between the different pairs along the tube 41, in order to provide for different ergonomic heights of the lever 33, thereby facilitating positioning the aid 31 at different working heights.

When the height adjustment aid 31 has been arranged on the post 3, the distal end of the lever 37, comprising the connection to the support member 35, is positioned behind the post 3, relative to a user of the aid 31, and the connection point between the connector 39 and the lever 33 is positioned in front of the post 3. This provides for a good compromise between a large enough force exchange and a high enough height of the adjustment. The lever 33 should be short enough for a single person to simultaneously operate the lever 33 and the locking member 21, and long enough to provide for a desirable force exchange in order to enable an easy operation of the lever 33.

The connector 39 consists of a flexible belt 40 having a hook 42 at the free end thereof. Preferably, the length of the belt 40 is adjustable. The hook 42 is engageable with an aid connector 45 included in the holder 7. More particularly, in this embodiment, the loop 15, 17 of each mesh panel support 13, 14 constitutes an aid connector 45. In this embodiment, however, it is preferable to use the upper aid connector 45.

The height of the mesh panels is adjusted in the following way. For raising the mesh panels 5, firstly the tube 41 is placed on top of a post 3 and the hook 42 of the mesh panel holder connector 39 is engaged with the aid connector 45 of the upper mesh panel support 13 of a mesh panel holder 7, and the length of the mesh panel holder connector 39 is appropriately adjusted. Then the screw 27 is undone to loosen the clamp 23. Then the proximal end 38 of the lever 31 is simply raised. Thereby, the holder 7 is vertically moved along the post 3 to a higher position. Then, the lever 33 is kept still while the screw 27 is tightened. A single person is able to perform these steps, since it is possible to hold the lever 33 with one hand while tightening the screw with the other. The distance from the connection between the mesh panel holder connector 39 and the post 3 should not be too long in order to keep the angle between the mesh panel holder connector 39 (when stretched) and the post small enough not to cause undesired friction between the post connector 11 of the mesh panel holder 7 and the post 3.

For lowering the mesh panels 5 the operation is identical except for the operation of lowering the lever 33 instead of raising it.

Above, embodiments of the temporary safety barrier system according to the present invention have been described. These should be seen as merely non-limiting examples. As understood by those skilled in the art, many modifications and alternative embodiments are possible within the scope of the invention, as defined by the claims.

Figure 4:
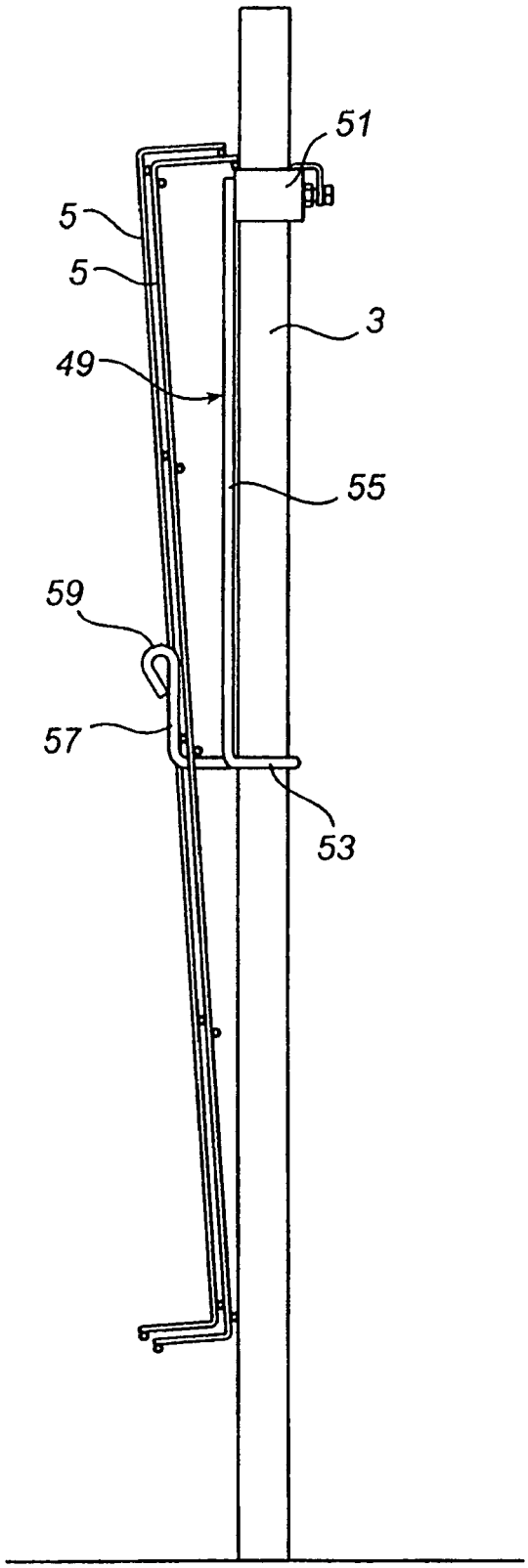
FIG. 4 in a side view shows a part of a safety barrier system according to another embodiment of the present invention.

An alternative embodiment is shown in FIG. 4. It differs from the embodiment described above in that the mesh panel holder 49 comprises a single mesh panel support 57, which is similar to the lower mesh panel support 14 of the other embodiment. Thus, the mesh panel holder comprises a post connector 51, encircling the post 3. Further, it comprises a round bar attached at one end thereof to the post connector 51, and formed into a straight portion 55, a ring shaped portion 53 encircling the post 3, a hooked portion 57 supporting the mesh panel 5, and a free end portion formed into a loop 59 and constituting the aid connector. The single support 57 is positioned vertically about in the middle of the mesh panel 5.

The mesh panel support can be formed in different ways. For example a flat iron bar can be bent and provided with a hole for the aid connector.

The height adjustment aid is not a necessary part of the system, since the mesh panel holders are adjustable per se, but considering the ordinary weight of a present mesh panel the height adjustment aid substantially enhances the height adjustment.

For example, the connector for connecting the aid to the mesh panel holder can be a length adjustable rigid rod. However a flexible connector is preferable.

For example, the support member can be formed as a cap or a gripping means that grips of the post.

For example, the lever of the height adjustment aid can be provided with a brake or a ratchet or the like that prevents the lever from lowering until released, preferably by means of a release means at the proximal end of the lever.

Alternative locking members are, for example, an eccentric locking member, a wedge locking member, a clamping member, etc.

For example, the shape of the post can be square, polygonal, etc.

In embodiments where the mesh panel holder has two mesh panel supports, the distance between them can be adjustable, thereby being more adaptable to different mesh sizes. However a rigid connection is preferable considering the simplicity of the holder.

The invention claimed is:

1. A temporary safety barrier system comprising a plurality of posts, a plurality of mesh panels, and a plurality of mesh panel holders, wherein each mesh panel holder is adapted to be mounted on a respective post of said plurality of posts, and comprises a post coupler, a first mesh panel support, and a second mesh panel support, which is distanced from said first mesh panel support in a longitudinal direction of said post in a mounted state, wherein the mesh panel supports are adapted to be attached in common to said post coupler, wherein the post coupler is adapted to move along the post when mounted thereon, for enabling height adjustment of said mesh panels in a mounted state, and comprises a locking member adapted to releasably lock the post coupler in a holding position at the post, wherein said second mesh panel support encircles said post in the mounted state, wherein each mesh panel support has a support hook adapted to receive a mesh wire of one or more mesh panels, and wherein the mesh panels are adapted to move on the mesh panel holders during height adjustment to enable inclination of a mesh panel during said height adjustment, and further comprising a height adjustment aid for aiding height adjustment of the mesh panels in the mounted state, said height adjustment aid comprising a lever, a support member adapted to be located at a portion of a post and to be pivotably connected to the lever, and a mesh panel holder connector engageable with said mesh panel holder and adapted to be pivotably connected with the lever to apply a force to raise or lower a mesh panel, wherein pivoting of the lever causes the at least one mesh panel holder to raise and/or lower a mesh panel.

2. The temporary safety barrier system according to claim 1, wherein at least one of said mesh panel holders has an aid connector in a loop-shape.

3. The temporary safety barrier system according to claim 2, wherein said aid connector and said support hook of each mesh panel support are all formed in a plane approximately perpendicular to the plane in which the mesh panels extend between the posts.

4. The temporary safety barrier system according to claim 2, wherein said aid connector and said support hook of each mesh panel support are all formed in a plane approximately perpendicular to the plane in which the mesh panels extend between the posts.

5. The temporary safety barrier system according to claim 2, wherein said mesh panel supports are arranged at a fixed distance from each other.

6. The temporary safety barrier system according to claim 3, wherein said mesh panel supports are arranged at a fixed distance from each other.

7. The temporary safety barrier system according to claim 1, wherein said locking member includes a screw locking means comprising a screw and a clamp, wherein the clamp is forceable against the post by means of the screw.

8. The temporary safety barrier system according to claim 1, wherein said mesh panel supports are arranged at a fixed distance from each other.

9. The temporary safety barrier system according to claim 1, wherein said post coupler comprises a ring shaped portion arranged to encircle the post in the mounted state.

10. The temporary safety barrier according to claim 1, wherein the mesh panels have upper and lower edge elements protruding substantially perpendicularly from the upright wires of the mesh panels such that the mesh panels have a Z-shape in a side elevational view thereof and a lowermost mesh panel support is located near the center of the height of the mesh panels when the mesh panels are installed on the posts.

11. A temporary safety barrier system comprising a plurality of posts, a plurality of mesh panels, and a plurality of mesh panel holders, wherein each mesh panel holder is mountable on a respective post of said plurality of posts, and comprises a post coupler, a first mesh panel support, and a second mesh panel support, which is distanced from said first mesh panel support in a longitudinal direction of said post in a mounted state, wherein the mesh panel supports are attached in common to said post coupler, wherein the post coupler is movable along the post when mounted thereon, for enabling height adjustment of said mesh panels in a mounted state, and comprises a locking member for releasably locking the post coupler in a holding position at the post, wherein said second mesh panel support encircles said post in the mounted state, wherein each mesh panel support has a support hook for receiving a mesh wire of one or more mesh panels, and wherein the temporary safety system is arranged to enable inclination of a mesh panel during said height adjustment, wherein at least one of said mesh panel holders comprises an aid connector, which is adapted to be connected with a height adjustment aid, and further comprising a height adjustment aid for aiding height adjustment of the mesh panels in the mounted state, said height adjustment aid comprising a lever, a support member which is adapted to be located at an upper portion of a post and which is pivotably connected with the lever at a first connection portion, said lever also being pivotably connected with a mesh panel holder at a second connection portion said first and second connection portions being spaced along said lever, wherein pivoting of the lever causes the at least one mesh panel holder to raise and/or lower a mesh panel.

12. The temporary safety barrier system according to claim 11, further comprising a means for positioning the height adjustment aid at different heights relative to the post.

13. The temporary safety barrier system according to claim 12, wherein said mesh panel supports are arranged at a fixed distance from each other.

14. The temporary safety barrier system according to claim 11, wherein said mesh panel supports are arranged at a fixed distance from each other.

15. A method of adjusting the height of a mesh panel in a mounted with respect to an existing position, wherein said mesh panel is comprised in a temporary safety barrier system, which further comprises a plurality of posts each having a mesh panel holder which is movably arranged on the post and comprises a mesh panel support supporting the mesh panel, the method comprising:

arranging a support member of a height adjustment aid, said height adjustment aid comprising a lever, a support member which is adapted to be located at an upper portion of a post and which is pivotably connected with the lever at a first connection portion, said lever also being pivotably connected with a mesh panel holder at a second connection portion, said first and second connection portions being spaced along said lever, wherein pivoting of the lever causes the at least one mesh panel holder to raise and/or lower a mesh panel;

connecting said mesh panel holder, which is pivotably connected to the lever at a second connection portion longitudinally spaced from said first connection portion, to said mesh panel holder releasing said mesh panel holder from said post;

moving the mesh panel holder along the post into a new position by changing the vertical position of a proximal end of said lever; and locking said mesh panel holder at said post in said new position.

16. A temporary safety barrier system comprising a plurality of posts, a plurality of mesh panels, and a plurality of mesh panel holders, wherein each mesh panel holder is mountable on a respective post of said plurality of posts, and comprises a post coupler, a first mesh panel support, and a second mesh panel support, which is distanced from said first mesh panel support in a longitudinal direction of said post in a mounted state, wherein the mesh panel supports are attached in common to said post coupler, wherein the post coupler is movable along the post when mounted thereon, for enabling height adjustment of said mesh panels in a mounted state, and comprises a locking member for releasably locking the post coupler in a holding position at the post, wherein said second mesh panel support encircles said post in the mounted state, wherein each mesh panel support has a support hook for receiving a mesh wire of one or more mesh panels, and wherein the temporary safety system is arranged to enable inclination of a mesh panel during said height adjustment, wherein at least one of said mesh panel holders comprises a loop shaped aid connector, which is arranged to be connected with a height adjustment aid, wherein said aid connector and said support hook of each mesh panel support are all formed in a plane approximately perpendicular to the plane in which the mesh panels extend between the posts, and further comprising a height adjustment aid for aiding height adjustment of the mesh panels in the mounted state, said height adjustment aid comprising a lever, a support member, which is connectible with an upper portion of a post for supporting the height adjustment aid, said lever being pivotably connected with said support member at a first connection portion, and a mesh panel holder connector pivotably connected with the lever at a second connection portion, and connectible with said aid connector, said first and second connection portions being spaced along said lever, wherein pivoting of the lever causes the at least one mesh panel holder to raise and/or lower a mesh panel.

17. The temporary safety barrier system according to claim 16, wherein said mesh panel supports are arranged at a fixed distance from each other.

18. The temporary safety barrier system according to claim 16, wherein said post coupler comprises a ring shaped portion arranged to encircle the post in the mounted state.

19. A temporary safety barrier system comprising a plurality of posts, a plurality of mesh panels, and a plurality of mesh panel holders, wherein each mesh panel holder is mountable on a respective post of said plurality of posts, and comprises a post coupler, a first mesh panel support, and a second mesh panel support, which is distanced from said first mesh panel support in a longitudinal direction of said post in a mounted state, wherein the mesh panel supports are attached in common to said post coupler, wherein the post coupler is movable along the post when mounted thereon, for enabling height adjustment of said mesh panels in a mounted state, and comprises a locking member for releasably locking the post coupler in a holding position at the post, wherein said second mesh panel support encircles said post in the mounted state, wherein each mesh panel support has a support hook for receiving a mesh wire of one or more mesh panels, and wherein the temporary safety system is arranged to enable inclination of a mesh panel during said height adjustment, wherein at least one of said mesh panel holders comprises a loop shaped aid connector, which is adapted to be connected with a height adjustment aid; and further comprising a height adjustment aid for aiding height adjustment of the mesh panels in the mounted state, said height adjustment aid comprising a lever, a support member, which is connectible with an upper portion of a post for supporting the height adjustment aid, said lever being pivotably connected with said support member at a first connection portion, and a mesh panel holder connector pivotably connected with the lever at a second connection portion, and connectible with said aid connector, said first and second connection portions being spaced along said lever, wherein pivoting of the lever causes the at least one mesh panel holder to raise and/or lower a mesh panel.

* * * * *